United States Patent [19]

Crites

[11] 4,019,971

[45] Apr. 26, 1977

[54] METHOD OF RECOVERING FINE GOLD FROM ORE

[75] Inventor: Virgil C. Crites, Tustin, Calif.

[73] Assignee: Peter J. Bonin, Tustin, Calif.

[22] Filed: Sept. 22, 1975

[21] Appl. No.: 615,623

[52] U.S. Cl. ..... 204/130; 204/126

[51] Int. Cl.[2] ..... C25C 1/22

[58] Field of Search ..... 204/126, 124, 109, 250, 204/130; 75/118 R

[56] References Cited

UNITED STATES PATENTS

| | | | |
|---|---|---|---|
| 756,223 | 4/1904 | Fahrig | 204/250 |
| 905,048 | 11/1908 | Beaumont | 204/250 |
| 2,991,239 | 7/1961 | Tyer | 204/109 |

*Primary Examiner*—R. L. Andrews
*Attorney, Agent, or Firm*—Knobbe, Martens, Olson, Hubbard & Bear

[57] ABSTRACT

Ore bearing small particles of precious metal which forms an amalgam with mercury is passed in a water-ore pulp first over a positively charged conductive surface to neutralize particles of organic matter and then over amalgamating plates, flouring of mercury on the amalgamating plates being inhibited by the discharge of organic particles in the pulp.

9 Claims, 3 Drawing Figures

METHOD OF RECOVERING FINE GOLD FROM ORE

This invention relates to ore dressing and more specifically to the dressing of ores containing precious metals, primarily gold and silver. More specifically, this invention relates to an improvement in the amalgamation process for recovering fine particles of precious metal.

The amalgamation process for recovering precious metals, e.g., gold and silver, and its applicability to the recovery of rare metals is well known and extensively described in the prior art. The process is described briefly hereinafter for convenient reference, but standard texts and treatises on ore dressing should be consulted for complete details, see, for example, Richards and Locke, TEXTBOOK OF ORE DRESSING, Second Edition, McGraw-Hill, 1925; E. M. Wise, Editor, GOLD: RECOVERY, PROPERTIES AND APPLICATIONS, D. Van Nostrand Company, 1964.

If a clean grain of certain metals, gold, for example, comes in contact with clean mercury, the particle becomes either entirely combined or superficially coated with mercury, according to its thickness, and if two such particles come in contact with each other, they are loosely cemented or soldered together. Such aggregations, which are alloys of the metals with mercury, are called amalgams. Mercury readily unites with silver and gold and is most commonly used for the recovery of these precious metals. It also unites readily with certain rare metals as well as with copper, lead, tin, cadmium, zinc, bismuth, sodium and potassium. Certain metallic compounds are decomposed, under favorable conditions by mercury, forming a mercury salt and an amalgam.

In addition, by using a voltaic couple with a dilute acid and mercury as the negative electrode, mercury unites with nickel, cobalt, manganese, iron, chromium, aluminum, and platinum. Mercury forms an amalgamum with these metals when their salts are treated by electrolysis with mercury as the negative electrode.

In the following discussion and throughout this specification, reference will be made to gold as exemplary of those materials forming amalgams and to gold ore is exemplary of those ores from which precious metals may be recovered with the understanding that this is merely exemplary and not restrictive. Amalgamation is most commonly used to recover gold and, and somewhat less commonly, to recover silver but the application of this invention is not restricted to any specific ore or specific dressing process.

Very briefly and basically, the amalgamation process comprises passing a pulp over an amalgamating plate in such a manner as to cause metal particles in the pulp to come into contact with the amalgamating plate to be collected from the pulp by amalgamation. The term "pulp" as used in this specification refers to mixtures of pulverized ore and water. Th pulp may be formed in any manner. Typically, the pulp may be formed by mixing ore bearing sand or pre-crushed ore with water, as the output of a steam or gravity stamp or other grinder. The equipment used and the method for forming and introducing the pulp into the apparatus is not critical and is of little consequence as long as good ore dressing practice is used.

There are several kinds of amalgamating plates which may be used in ore dressing. For convenient reference, sluice plates will be described as a typical apparatus for carrying out the amalgamation process. This invention is, of course, not limited to any particular type of amalgamating plate. In general amalgamating plates take the form of copper plates coated with mercury amalgam. These plates are usually set at an angle so that the pulp will flow evenly over the plate and bring the free metal into contact with the mercury. The slope of the plate is an important adjustment, is well understood and largely imperical and is easily arrived at using ordinary good ore dressing technique. Typically, slopes found in mills may vary from about 1 inch to about 2 ½ inches per foot. The slope of the plate will, however, depend upon the amount of sulphides in the ore, the fineness of the crushing, the width of the plate, etc. The rule which appears to be generally followed in adjusting the slope of the amalgamating plate is to make the slope as small as possible without allowing sulphurets to deposit. (A sulphurets is the undecomposed metallic ore, usually sulphides, and is chiefly applied to auriferous pyrites.) When the slope is right, the pulp covers the whole plate and flows down in a series of waves which roll the grains in the pulp over and over and give them an opportunity to come in contact with the surface of the plate. The speed of these waves is an indication of a correct adjustment and varies from 23 to 42 inches per second. The total plate area is also an imperically arrived at value and is best described as simply sufficient area to catch practically all of the free gold, or other precious metal. Since it is important that there be a relatively uniform flow of pulp over the plate, the thicker the plate the less danger there is of it becoming dented. A fairly standard thickness is one-eighth inch.

Almagating plates may be copper coated with mercury, copper coated with silver amalgam or gold amalgam, copper plated with silver and coated with mercury or special copper alloys coated with mercury. There are various techniques for preparing amalgamating plates which depend upon the particular substrate metal. In general, it is essential that the substrate surface be freshly cleaned. The reader should, however, consult the prior art literature for specific preparation and other details of the method for preparing particular amalgamating plates.

An extreme difficulty in amalgamation is the "flouring" of mercury on the amalgamating plates. This term is used to denote the separation of mercury into minute globules, the globules being prevented from reuniting in the presence of a film of oxide, grease, or other foreign substances, usually an organic film of some type. The organic material may result from the mining operation, e.g. wax, lubricants, etc., introduced from machinery, etc., or may occur naturally in the ore or water from the decomposition from plant and animal matter. The term "sickening" is sometimes used to refer to the coating over of mercury globules which prevents them for reuniting.

The most common attempts to inhibit flouring of the amalgam has been to add an alkali, such as soda, lye, burnt lime, etc. to the pulp or to run the pulp over broken limestone.

The present invention is an improvement in the amalgamation process and comprises a process and apparatus for inhibiting flouring and thereby increasing the efficiency and effectiveness of the amalgamation process and making the process economically feasible for ores and under conditions which would otherwise be impossible or impractical.

According to the present invention, the organic negatively charged material in the slurry, which causes the flouring or sickening of the amalgam, is discharged or altered by passing the pulp through an electric field over the positively charged conductive surface before the pulp is passed over the amalgamating plate. Some of the organic matter is collected on the discharging surface, some coalesces into larger particles which have little tendency to cause flouring, and other particles are simply discharged to render them non-sickening to the mercury surface.

The present invention also contemplates an apparatus for carrying out the process, one comparatively simple and merely exemplary apparatus being shown in the drawings, which also illustrate the process in an exemplary, non-limiting manner.

Figure 1:
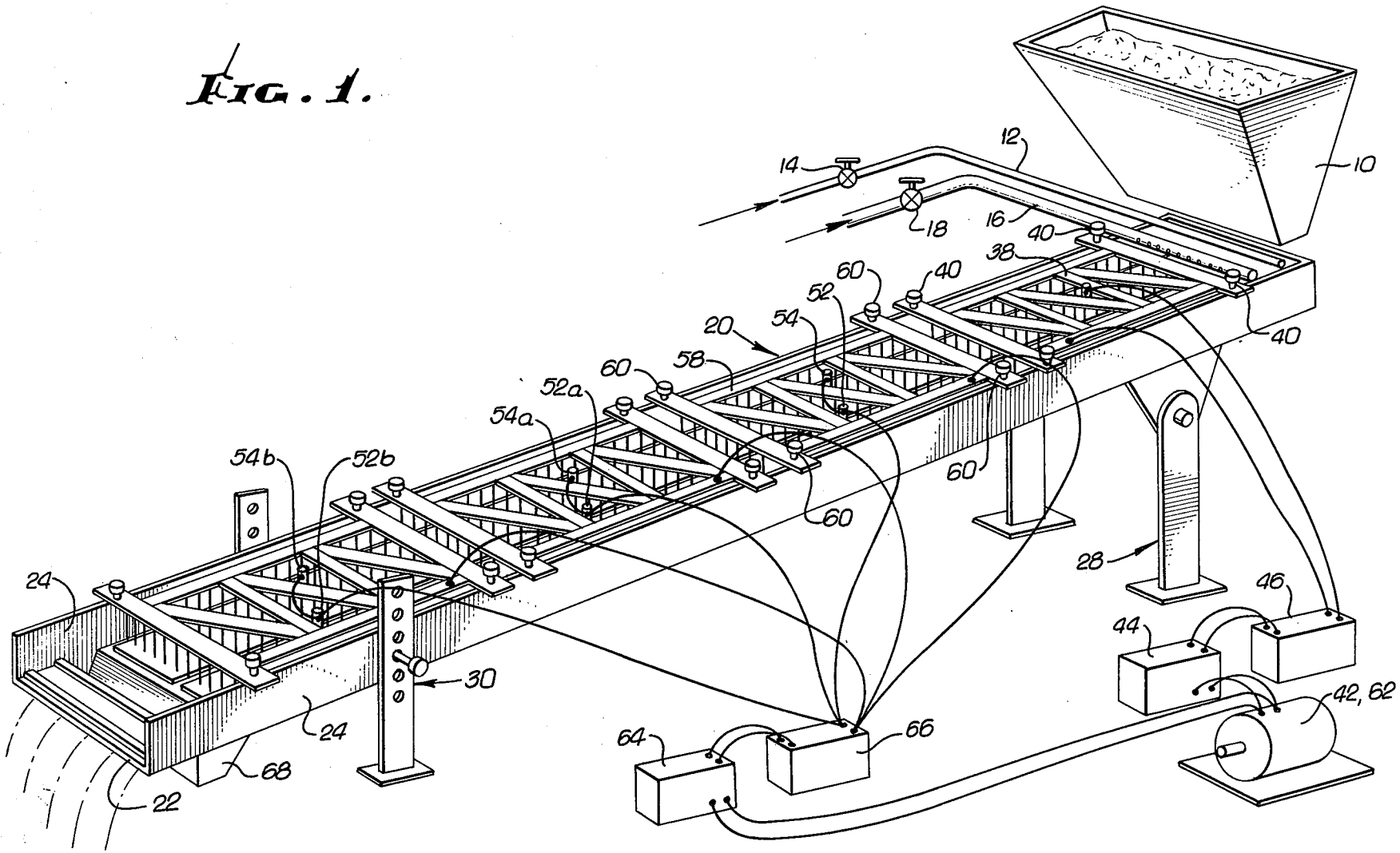
FIG. 1 is a partial schematic perspective view of a sluice apparatus for carrying out and illustrative of the inventive process.
Figure 2:
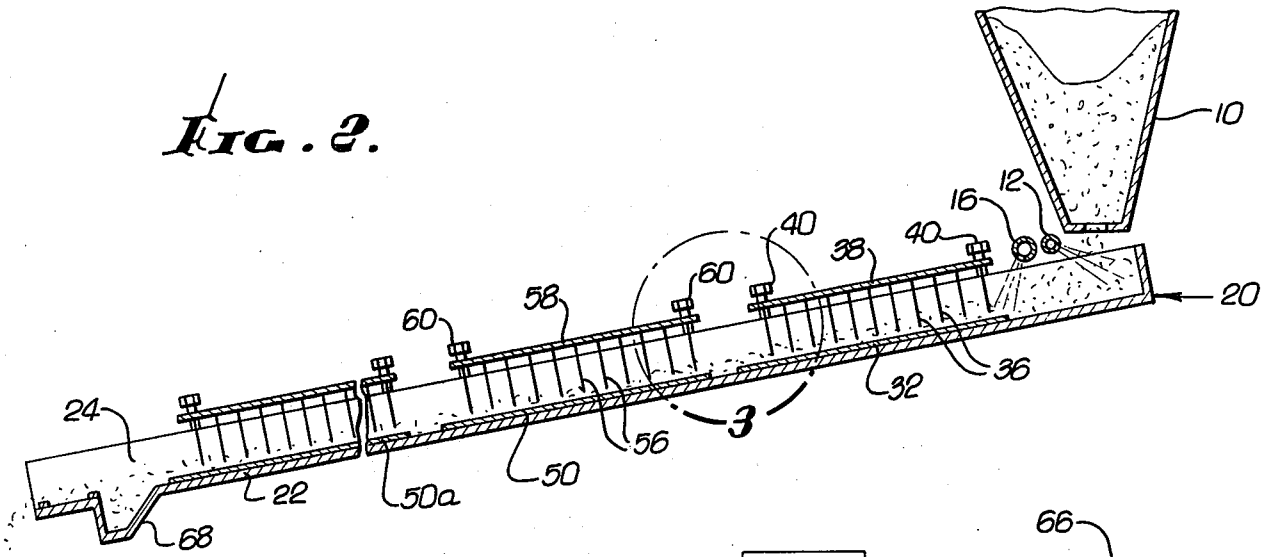
FIG. 2 is a side view, partially in schematic, of the sluice in FIG. 1.

The process will be described as carried out in the illustrated apparatus with the understanding that this use of the apparatus depicted in the drawings is merely for convenience in describing the process and than no particular apparatus is necessarily required for carrying out this process and, further, that considerable variation in the apparatus is possible without departing from the invention.

In general, the apparatus comprises a hopper 10, or other means for introducing ore to the end of the sluice. For example, the ore may come directly from a gravity stamp or ball mill or another type of crusher. The pulp is formed by spraying water under high pressure from a mixing water line 12 directly into the ore that falls from the hopper, the flow rate and pressure being controlled by a mixing control valve 14. The rate of flow of the pulp down the sluice is a function of the amount of water added to the initially formed pulp through an input water line 16, the volume of water being controlled by a material flow control valve 18.

The sluice 20 is made of a non-conductive material, such as platic, wood, etc., or of a non-conductive coated material such as plastic coated steel or the like, and is of a conventional design having a bottom 22 and sides 24 and 26. The sluice is preferably supported on means such as a pair of legs indicated generally at 28 and a second pair of legs indicated at 30 which will permit the slope of the sluice to be adjusted according to the particular requirements of the ore being dressed, as described hereinbefore, using good ore dressing technique.

Figure 3:
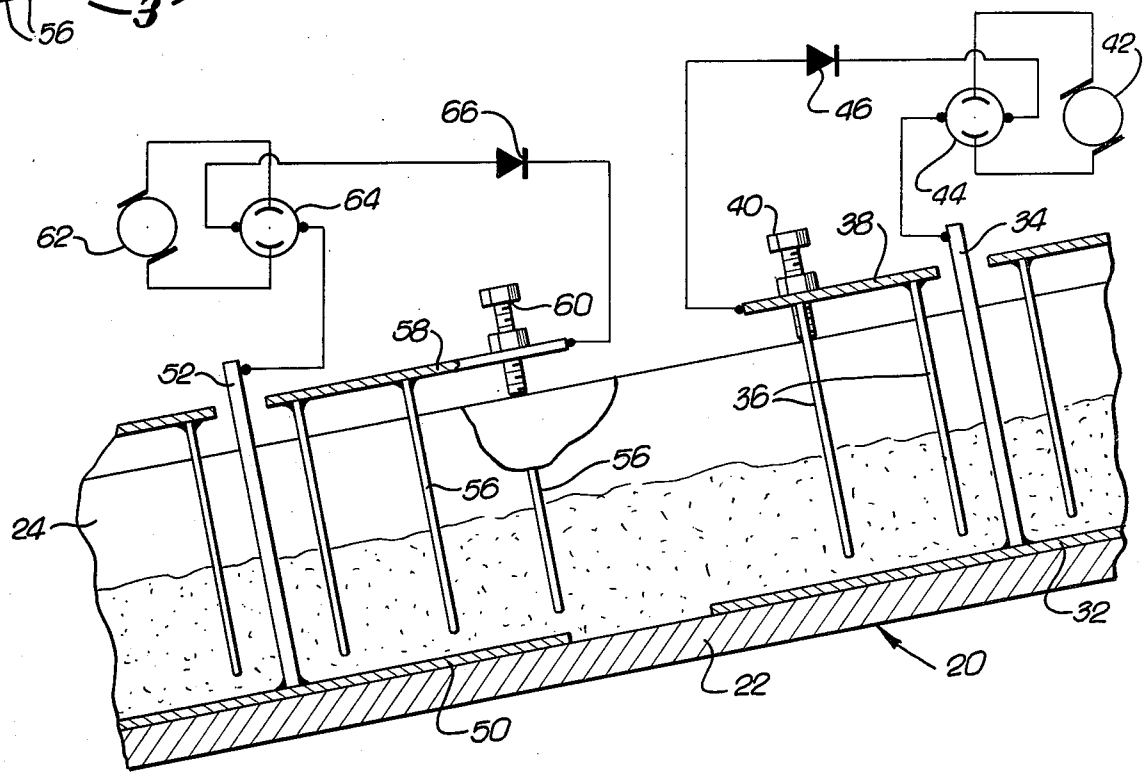
FIG. 3 is an enlarged view of the portion of the sluice indicated in FIG. 2 showing, partially in schematic, the means for charging the conductive surface and the amalgam plate and applying an electric field through the pulp.

A conductive surface 32 the top of which is conveniently in the form of an iron plate secured to the non-conductive bottom surface of the sluice, is provided downstream from the means for introducing the pulp in the sluice. As best illustrated in FIG. 3, the conductive surface is connected by an electrical connector 34 to a source of electrical potential, which will be described in greater detail hereinafter. Spaced from and above the charged surface 32 are a multiplicity of electrodes 36, each of which in the preferred embodiment, is an elongate rod, such as an ordinary iron nail, extending toward the surface 32 generally in a perpendicular relationship with respect to the surface. The specific positional relationship of the electrode 36 with respect to the surface 32 is not critical and a great deal of variation is permitted in this respect. In general it is desirable to provide electrodes which have considerably less contact area with the water-ore pulp than has the plate 32. The effective surface area of the plate 32 which is in contact with the pulp is many times, in the preferred embodiment, the effective surface of the electrodes 36 in contact with the pulp, e.g., the effective surface area of the surface 32 may be from 3 to 300 times, typically about 100 times, as much as the effective surface area of the electrodes. The reasons for this relationship will become apparent as the apparatus and process are described more fully.

The electrodes 36 are connected to conductive support bars 38 which can be moved closer to or further away from the conductive surface 32 by adjusting means 40 at each end of the support rods. An electric field is applied between the surface 32 and the electrodes 36 from any conventional source of electricity. Merely as an illustration of an exemplary means for providing an electric potential between the surface 32 and the electrodes 36, and AC generator 42 is illustrated as being connected to an adjustable auto transformer 44 which is capable of varying the AC voltage supplied to rectifier 46 thereby controlling the voltage output of the electrode support arms 38 and to the electrodes 36 on the negative side of the rectifier and through connector 34 to the conductive surface 32 on the positive output side of the rectifier. Thus, the iron, or other metal or conductive material, plate 32 thus becomes a positively charged conductive surface over which the pulp passes as it flows downwardly through the sluice trough.

It will be immediately apparent that many means for providing the electric potential are available. For example, the potential can be applied directly from storage batteries or from any other source of AC or DC voltage through appropriate rectifiers, in the case of AC voltage, and voltage regulating mechanisms.

Downstream from the positively charged conductive surface there is positioned one or more amalgamating plates 50 and **50*a* to which a negative voltage is applied through a connector 52 and 52*a*. Where two amalgamating plates are laid side by side, as in the exemplary embodiment, an additional connector pole 54 or 54*a*** may be required to provide a negative charge on the amalgamating plates as described more fully hereinafter, if this is desired.

Electrodes 56 supported by bars 58, the height of which are adjustable by means of a threaded bolt 60, which are similar or identical in construction to the electrode-bar system 36 and 38 described before, is used to position the electrodes in spaced relation from and above the amalgamating plate 50. An electric potential is applied from any convenient source, such as an AC generator 62, voltage regulating device 64, and rectifier 66, all as previously described with respect to the means for applying voltage to the surface 32, is applied between the electrodes 56 and the amalgamating plate 50. The electrodes 56, like the electrodes 36, extend down into the pulp and apply an electric field through the pulp between the amalgamating plate and the electrodes. The amalgamating plate has several times, e.g., from about 3 to 300 times, the effective surface contact with the pulp as do the electrodes 56.

The effective electric field surrounds that portion of the electrode area which is submerged in the pulp. The electrical application and connection to the amalgamating plate differs from the previously described system in that the amalgamating plate is charged negatively while the electrodes are charged positively. This mechanical and electrical arrangement may be duplicated as many times as desired down the length of the sluice, as indicated, for example, by the connector rods **52*b* and 54*b*** to amalgamating plates lying still further down the stream.

Down the stream from all of the amalgamating plates it is desirable to provide a mercury trap 68 which may be of any design suitable in good ore dressing practice. Reference is made to the aforementioned or comparable ore dressing texts or treatises for various designs of mercury traps.

In one embodiment of the apparatus, by which the invention was reduced to practice, the positively charged surface was a sheet of steel 3 feet long and 14 inches wide, the width of the sluice flume, and was charged positively with a 5.4 volt potential. In the sluice flume immediately below the positively charged surface, a copper plate one eighth inch in thickness, 58 inches long, and 14 inches wide, coated with mercury, was placed to form the amalgamating plate. The electrodes were spaced approximately one half inch above the plates in both instances. The spacing of the electrodes is subject to considerable variation and is best imperically for a given sluice and ore. The voltage applied between the electrodes and the subjacent amalgamating plate was 6 volts. The current varies according to the electrical resistance of the pulp, which is a function of the density and volume being processed. The rectifier used was rated at 6 volts, 100 amperes.

The apparatus as described before was tested by placing it in operation on a northern California placer. After running 1¾ yards gross material through the system, removing the coarse gravel by a classifier before forming the pulp which is then passed through the electric field over the positively charged surface and then through the electric field and over the negatively charged amalgamating plate, the amalgamating plate appeared to be the color of a gold bar and was well loaded with gold. The device was shut down and the mercury was removed from the amalgamating plates with a squeegy. A long tail of gold would appear behind the mercury as it was removed. It was estimated that about 2½ ounces had been recovered in the operation. The mercury did not flour or leave the copper plates.

Additional experiments were run using ore taken out of the placer bank on a miniature apparatus which contained 0.11 square foot of amalgam plate. On the initial run some gold was recovered but it was disappontingly low because the voltage used was too high with too high current density on the amalgamating plates. The optimum current density for this particular size of plate was calculated to be 0.9 ampere. With this current density, the recovery was more than 10 times that of the first run.

The optimum current density is a function of the particular apparatus, the spacing of the electrodes above the plate, and the applied voltage. With the spacing of approximately one half inch, an applied voltage of approximately 5.3 volts, and under the conditions of the test, the optimum current density was about 0.9. The optimum current density for any particular apparatus, ore and conditions is easily determined simply by a few experiments measuring the current density at which maximum gold or other precious metal is collected. Conventional analytical or assay methods are used in determining the quantity of precious metal collected.

The gold collected in these tests included gold which was so finely divided that it is believed to be in the collodial state. It is postulated that the charged particles of gold, the collodial gold particles, were altered as they passed over the positively charged plate to an extent to cause them to coalesce to form larger particles which made it possible to collect them by the amalgamating process, a result which would not othewise have been possible. Whether or not this is exactly the phenomenon which brings about the result has not yet been verified but a new and unexpected result, efficient recovery of collodial gold, has been obtained.

Of perhaps more economic significance, is the fact that in all cases, flouring of the amalgam was very greatly inhibited or completely avoided by passing the pulp over the positively charged surface before it was passed over the amalgamating plate. The application of the electric field between the amalgamating plate and the electrodes spaced therefrom aides in the more efficient recovery of the gold, since the gold particles are positively charged and, therefore, are attracted to the negatively charged amalgamating plate. But the principal effect and the advantage of this invention is that the amalgamating surface remains intact without the flouring and consequent destruction which had occured using these ores but without the preliminary step of passing the pulp over the positively charged surface.

It is postulated, with a comparatively high level of confidence, that the mechanism by which the flouring of the mercyry amalgam is prevented or substantially inhibited is that the organic matter in the ore or water, which normally bears a negative charge, is discharged as the pulp is passed over the positively charged surface. The organic matter apparently collects on the positively charged surface, coalesces to larger particles which do not have the same sickening effect on mercury as do the small, finely divided and highly charged organic particles, and simply by discharging or neutralizing the organic particles themselves such that they do not tend to attach to or become attracted to mercury surfaces. In any event, a new and exciting result has been achieved which will make possible the use of the amalgamation process in many circumstances and with many ores with which the process would otherwise be useless.

It will be apparent that the apparatus described is comparatively simple and is intended to illustrate the invention and not necessarily to depict the best form of apparatus for carrying out the process. This particular form of apparatus was used in the reduction to practice but, of course, variations of considerable magnitude are possible. In one of the constructions used in carrying out the process, the support bar was a screen of large mesh and heavy wire to which iron nails were welded or through which they were simply extended. A great deal of variation is possible using ore dressing techniques without departing from the invention.

What is claimed is:

1. In the amalgamation process for recovering precious metal wherein ore containing particles of a precious metal which form a mercury-metal amalgam upon contact of clean metal with clean mercury is passed in water ore pulp over one or more mercury coated amalgamating plates to thereby cause such precious metal particles to contact and adhere to the mercury coating by amalgamation, the improvement comprising inhibiting flouring of mercury for the amalgamating plates by creating an electric field between at least one electrode charged relative to a positively charged metal surface, and passing the pulp over the positively charged metal surface before the pulp is passed over the amalgamating plate, whereby the pulp passes through the electric field between the positively charged metal surface and the negatively charged electrode.

2. The improved amalgamation process defined in claim 1 wherein the amalgamating plate and the positively charged metal surface are in a sluice and the ore-water pulp is passed over the charged surface and then over the amalgamating plate.

3. The improved amalgamation process defined in claim 2 wherein the electric potential is of a low enough voltage below about 20 volts to prevent accidental injury from electric shock to a person who may come into contact with said voltage.

4. The improved amalgamation process defined in claim 2 wherein the ore is gold bearing ore.

5. The improved amalgamation process defined in claim 4 wherein the electric field is applied by supporting a multiplicity of electrodes above said charged surface and applying from about 3 to about 20 volts across the space between the electrodes and the charged surface and passing the water-ore pulp through said space in contact with the charged surface and the electrodes.

6. The improved amalgamation process defined in claim 2 including the additional step of applying an electric field between the amalgamating plate and electrodes spaced therefrom and in contact with the pulp, the amalgamating plate being charged negative and the electrodes being charged positive.

7. The improved amalgamation process defined in claim 2 wherein the electrode is elongated having an axis generally perpendicular to the charged surface thereby providing a positively charged surface having several times more effective contact surface area for solid particles in the water-ore pulp than the effective surface area of the generally perpendicular electrode.

8. A process for inhibiting flouring of mercury from precious metal amalgamating plates comprising passing a pulp of water and ore containing small particles of gold or silver over a positively charged surface through a space between the charged surface and negatively charged electrodes spaced therefrom, the electrodes being in contact with the pulp to thereby apply an electric field through the pulp to discharge negatively charged particles of organic matter as the pulp carries such charged particles into proximity to the positively charged surface and then passing the water-ore pulp over an amalgamating plate to collect the particles of gold or silver by amalgamation of the same with mercury on the amalgamating plate.

9. The process defined in claim 8 wherein the voltage between the negative electrode and the positive surface is from about 3 to about 20 volts.

* * * * *

UNITED STATES PATENT OFFICE

CERTIFICATE OF CORRECTION

Patent No. 4,019,971 Dated April 26, 1977

Inventor(s) Virgil C. Crites

It is certified that error appears in the above-identified patent and that said Letters Patent are hereby corrected as shown below:

Col. 1, Line 39/40 - "amalgamum" should be --amalgam--

Col. 1, Line 44 - "is" should be --as--

Col. 2, Line 9 - "imperical" should be --empirical--

Col. 1, Line 58 - "Th" should be --The--

Col. 2, Line 18 - "sulphurets" should be --sulphuret--

Col. 2, Line 26/27 - "imperically" should be --empirically--

Col. 2, Line 57 - "for" should be --from--

Col. 3, Line 30 - "than" should be --that--

Col. 4, Line 29 - "of" should be --to--

Col. 5, Line 30 - "imperically" should be --determined empirically--

Col. 5, Line 54/55 - "disappontingly" should be --disappointingly-

UNITED STATES PATENT OFFICE

CERTIFICATE OF CORRECTION

Patent No. 4,019,971 Dated April 26, 1977

Inventor(s) Virgil C. Crites

It is certified that error appears in the above-identified patent and that said Letters Patent are hereby corrected as shown below:

Col. 6, Line 13 - "othewise" should be --otherwise--

Col. 6, Line 30 - "occured" should be --occurred--

Col. 6, Line 35 - "mercyry" should be --mercury--

Col. 7, Line 4 - "for" should be --from--

Col. 7, Line 6 - After "electrode", insert --negatively--

Signed and Sealed this

Ninth Day of May 1978

[SEAL]

Attest:

RUTH C. MASON
Attesting Officer

LUTRELLE F. PARKER
Acting Commissioner of Patents and Trademarks